US009742113B1

(12) United States Patent
Bausch et al.

(10) Patent No.: US 9,742,113 B1
(45) Date of Patent: Aug. 22, 2017

(54) ELECTRICAL INTERFACE

(71) Applicants: HARRIS CORPORATION, Melbourne, FL (US); Debra Mueller, Rochester, NY (US)

(72) Inventors: Michael E. Bausch, Livonia, NY (US); Michael R. Mueller, Rochester, NY (US); Rollin Brown, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 15/400,719

(22) Filed: Jan. 6, 2017

(51) Int. Cl.

| | |
|---|---|
| ***H01R 13/631*** | (2006.01) |
| ***H01R 43/26*** | (2006.01) |
| ***H01R 13/18*** | (2006.01) |
| ***H01R 13/627*** | (2006.01) |
| ***H01R 39/64*** | (2006.01) |
| ***H01R 33/975*** | (2006.01) |

(52) U.S. Cl.
CPC ..... *H01R 13/6315* (2013.01); *H01R 13/18* (2013.01); *H01R 13/6276* (2013.01); *H01R 33/975* (2013.01); *H01R 39/643* (2013.01); *H01R 43/26* (2013.01)

(58) Field of Classification Search
CPC .. H01R 13/62; H01R 13/6276; H01R 13/533; H01R 33/975; H01R 39/643; H01R 13/18; H01R 13/6315; H01R 43/26
USPC ..... 439/248, 17, 345, 346, 347, 348, 382
See application file for complete search history.

(56) References Cited

U.S. PATENT DOCUMENTS

| | | | | |
|---|---|---|---|---|
| 3,444,504 | A | 5/1969 | Lynch et al. | |
| 3,808,590 | A | 4/1974 | Hemmer et al. | |
| 3,927,928 | A | 12/1975 | Pustell et al. | |
| 4,610,564 | A * | 9/1986 | Vantouroux | H01R 13/62 279/30 |
| 4,653,826 | A * | 3/1987 | Burgess | H01R 13/6315 439/248 |
| 4,847,588 | A | 7/1989 | Doutrich | |
| 6,231,401 | B1 | 5/2001 | Chooi Au Yong et al. | |
| 7,331,813 | B2 * | 2/2008 | Tsujita | F16B 21/165 439/348 |

(Continued)

FOREIGN PATENT DOCUMENTS

EP 2755282 A1 7/2014

*Primary Examiner* — Tulsidas C Patel
*Assistant Examiner* — Travis Chambers
(74) *Attorney, Agent, or Firm* — Fox Rothschild LLP; Robert J. Sacco; Carol E. Thorstad-Forsyth

(57) ABSTRACT

Systems and methods providing an electrical interface between a male plug (1002) and a female receptacle (100, 500, 1000, 1600). The methods comprise: receiving a conductive pin (402, 800, 1006, 1602) of the male plug in a socket opening (112, 900, 1012, 1612) of the female receptacle; providing (a) first spring loaded floating contact points (460) between an elongate body (422) of the conductive pin and an electrical contact (106A-106B) of the female receptacle and (b) at least one second spring loaded floating contact point (462) between a tip (420) of the conductive pin and the electrical contact (110) of the female receptacle, when the conductive pin is fully inserted into the female receptacle; and maintaining at least two of the spring loaded floating contact points when the pin moves within the socket opening as a result of an external force applied to the male plug or female receptacle.

20 Claims, 14 Drawing Sheets

(56) References Cited

U.S. PATENT DOCUMENTS

| | | | | |
|---|---|---|---|---|
| 7,794,285 | B1 * | 9/2010 | Huang | H01R 24/58 439/668 |
| 7,874,876 | B1 * | 1/2011 | Huang | H01R 24/58 439/668 |
| 8,342,867 | B2 | 1/2013 | Murphy et al. | |
| 8,568,301 | B2 * | 10/2013 | Watanabe | G02B 6/4298 439/180 |
| 8,840,430 | B2 | 9/2014 | Bausch et al. | |
| 2003/0077932 | A1 | 4/2003 | Lewinnek | |
| 2015/0031243 | A1 * | 1/2015 | Tada | B29C 65/16 439/626 |
| 2016/0190741 | A1 * | 6/2016 | Bulmer | H01R 12/771 439/329 |

* cited by examiner

ELECTRICAL INTERFACE

BACKGROUND OF THE INVENTION

Statement of the Technical Field

The present disclosure relates to electrical interfaces. More particularly, the present disclosure relates to electrical interfaces with floating contacts, contact redundancy and break away retention.

Description of the Related Art

There are many electrical interfaces known in the art. Some of these known electrical interfaces comprise spring fingers, fixed pins and/or pogo pins. These known electrical interfaces suffer from certain drawbacks. For example, a single point of contact is provided between a finger/pogo pin and a mating conductor. During severe shock and/or vibration, the contact between the finger/pogo pin and mating conductor can be lost. Additionally, the finger/pogo pin could be damaged as a result of excessive stress on the fixed points of the electrical interface. In effect, the reliability of such conventional electrical interfaces is not satisfactory for certain applications, such as military applications.

SUMMARY OF THE INVENTION

The present disclosure concerns systems and methods for providing an electrical interface between a male plug and a female receptacle. The method comprises: receiving a conductive pin of the male plug in a socket opening of the female receptacle; providing (a) a plurality of first spring loaded floating contact points between an elongate body of the conductive pin and an electrical contact of the female receptacle and (b) at least one second spring loaded floating contact point between a tip of the conductive pin and the electrical contact of the female receptacle, when the conductive pin is fully inserted into the female receptacle; and maintaining at least two of the first and second spring loaded floating contact points when the pin moves within the socket opening as a result of an external force applied to the male plug or female receptacle.

In some scenarios, the electrical contact comprises: a plurality of first elongate spring contacts extending in a first direction parallel to the center axis of the socket opening; and a second elongate spring contact extending in a second direction different than the first direction. The first and second elongate spring contacts are electrically connected to each other via a planar contact provided for connecting the female receptacle's electrical contact to an external circuit.

In those or other scenarios, the plurality of first spring loaded floating contact points is provided by a plurality of first conductive spring contacts respectively applying spring forces on a plurality of conductive retention members. The conductive retention members are slidingly disposed in a support structure of the female receptacle and in direct contact with the elongate body of the conductive pin. The first conductive spring contacts are spaced apart along a periphery of a support structure of the female receptacle. An elastic member applies a retention force on each said first conductive spring contact in a direction towards a center axis of the female receptacle. The elastic member may also provide an environmental seal at least reducing an ingress of contaminants into the socket opening. The second spring loaded floating contact point is provided by a second spring contact that is in direct contact with the conductive pin's tip.

In those or other scenarios, the following events occur as the pin is being inserted into the female receptacle: a first chamfered edge of the conductive pin slides against second chamfered edges of a plurality of conductive retention members disposed in the female receptacle whereby each said conductive retention member is urged from a first position in a direction away from the socket opening; pushing forces are respectively applied by the plurality of conductive retention members on a plurality of first spring contacts so as to cause the plurality of first spring contacts to flex away from the socket opening; and the plurality of first spring contacts respectively apply spring forces in directions towards the socket opening on the plurality of conductive retention members so as to cause each said conductive retention member to return to the first position when the conductive pin is inserted a certain distance into the socket opening.

BRIEF DESCRIPTION OF THE DRAWINGS

Embodiments will be described with reference to the following drawing figures, in which like numerals represent like items throughout the figures.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The present disclosure concerns electrical interfaces or connectors. The electrical interfaces or connectors solve many drawbacks of conventional electrical interfaces or connectors (such as those discussed in the background section of this document) associated with the following issues: loss of electrical contact during shock and vibration; stresses on Printed Wiring Board ("PWB") solder joints; stresses on connector pins; complexity and limitations of pogo pins; and/or precision alignment requirements for engagement between the male plug and the female receptacle.

The electrical interfaces or connectors discussed herein: provide electrical connections with contact point redundancy; allow for blind mating of the male plug and the female receptacle; provide strain relief at cable connections; and/or have environmentally sealed housings. The electrical interfaces or connectors also have a floating contact feature. The floating contact feature minimizes mating alignment errors and/or issues resulting from shock and/or vibration. In this regard, the floating contact feature allows the mating contact to float in at least two directions (e.g., X, Y and/or Z directions). The electrical interfaces or connectors further have a break-away retention feature. The break-away retention feature reliably allows components to break free from each other and/or their mounted position in emergency situations. This break-away retention feature is a requirement in many stationary and mobile applications where personnel safety and equipment survival cannot be compromised. Accordingly, the electrical interfaces or connectors are designed to allow the couplings of a male plug and a female receptacle to disconnect at selectable, predetermined forces.

Figure 10:
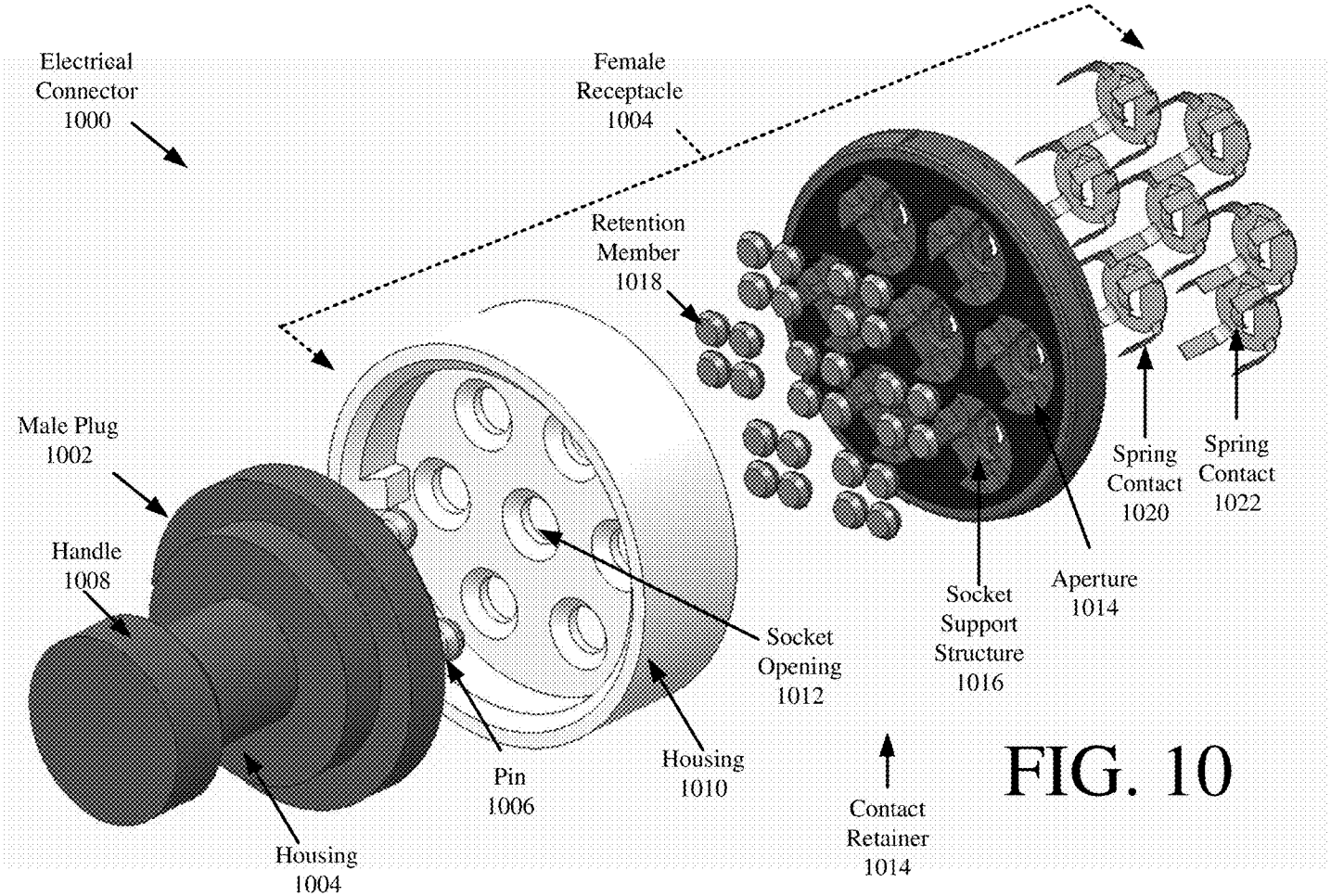
FIGS. 10 and 11 each provide an exploded view of another exemplary electrical connector with a male plug and a female receptacle.
Figure 11:
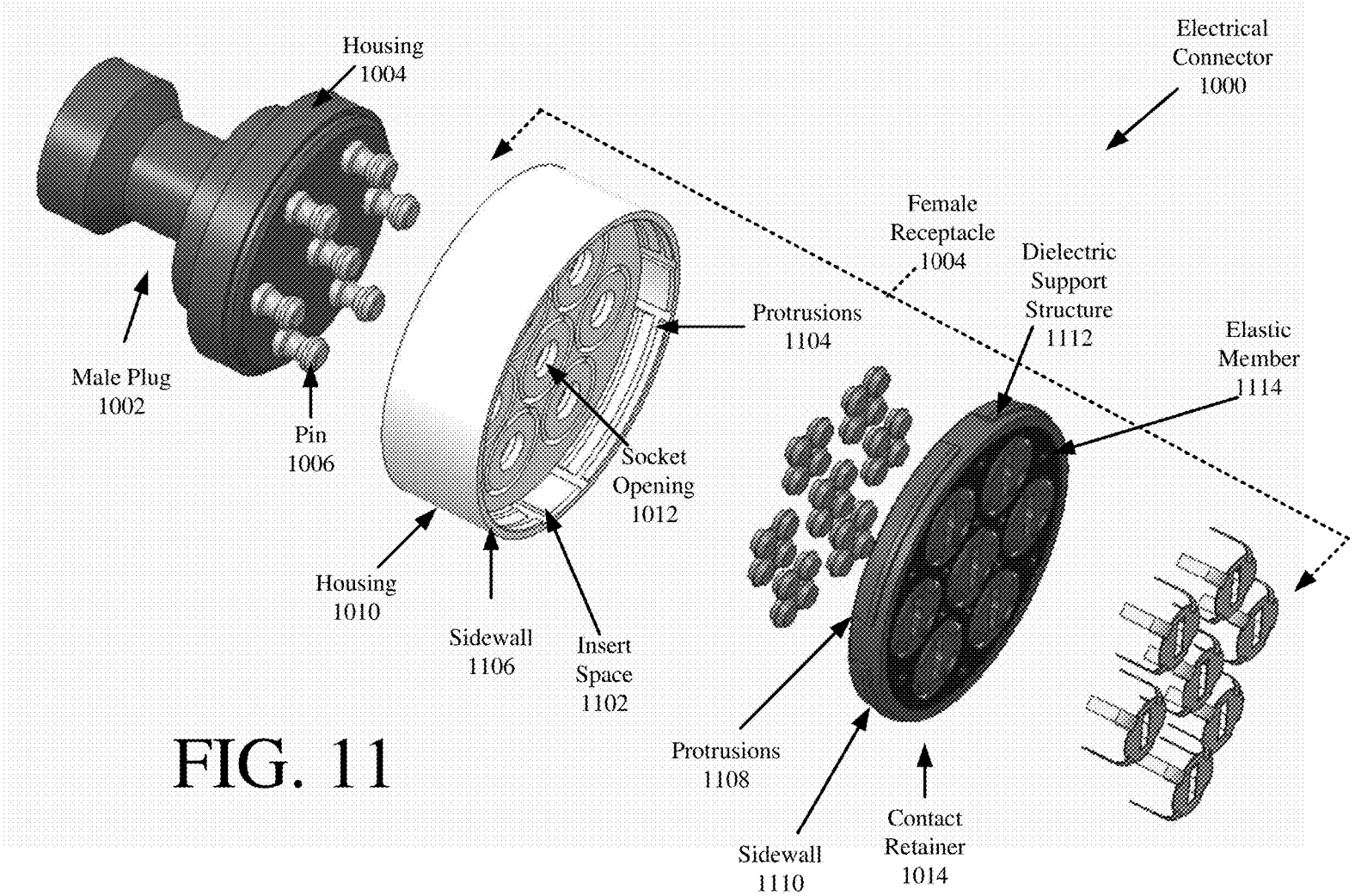

The male plug generally comprises a housing which supports at least one pin to be inserted into the female receptacle. An exemplary male plug is shown in FIGS. 10-11. The male plug of FIGS. 10-11 is shown with seven (7) pins. The present solution is not limited in this regard. The male plug can have any number of pins selected in accordance with a particular application. For example, the male plug used in connection with the female receptacle of FIGS. 1-4 has a single pin since the female receptacle has a single socket opening as described below.

Referring now to FIGS. 1-4, there are provided illustrations of an exemplary architecture for a female receptacle 100 having a single socket opening. The female receptacle 100 comprises a housing (or support structure) 102, a plurality of elastic members 104A, 104B, 104C, 104D, a plurality of spring contacts 106A, 106B, 106C, 106D, 110 and a plurality of retention members 108A, 108B, 108C, 108D. Although four (4) elastic members 104A-104D, spring contacts 106A-106D and retention members 108A-108D are shown in FIGS. 1-4, the present solution is not limited in this regard. Any number of elastic members, spring contacts and retention members can be employed in accordance with a given application.

Also, the respective placements of the elastic members, spring contacts and retention members need not be the same as that shown in FIGS. 1-4. For example, each spring contact may be offset from all other spring contacts as opposed to being aligned with one (1) other spring contact as shown in FIGS. 1-4 (e.g., spring contact 106A is aligned with spring contact 106D and spring contact 106B is aligned with spring contact 106C). In this regard, the spring contacts 106A-106D may or may not be equally spaced along a periphery of the housing (or support structure) 102. These statements apply equally to the elastic members and retention members 108A-108D.

Figure 4:
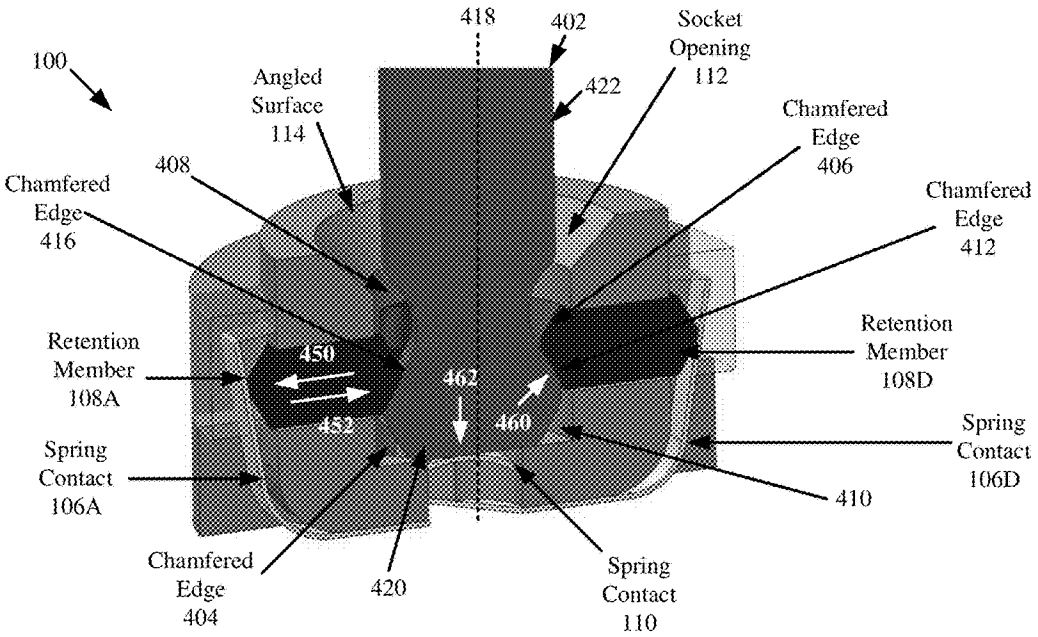
FIG. 4 is a cross-sectional view of the exemplary female receptacle shown in FIG. 1 with a pin of a male plug inserted therein.

The housing (or support structure) 102 is provided for housing and/or structurally supporting the elastic members, spring contacts and retention members. In this regard, the housing 102 is formed of rigid or semi-rigid dielectric material, such as plastic. The housing 102 comprises a socket opening (or aperture) 112 in which a pin 402 of a male plug (not shown in FIGS. 1-4) can be inserted into the female receptacle 100 so as to establish an electrical connection therebetween (as shown in FIG. 4).

Notably, five (5) floating contact points (spring loaded) are provided by the present solution which results in an electrical interface with extreme contact point redundancy. The extreme contact point redundancy and spring loading ensures that there are a minimum of two (2) points of contact at all times (even in extreme vibration and shock scenarios where the pin 402 moves around in the socket) between the male plug's pin and the female receptacle's electrical contact. In this regard, it should be understood that electrical connections are provided between the following components when the male plug and female receptacle are coupled to each other (in times when the connectors are not subjected to shock and vibration): (A) the pin's tip 420 and the spring contact 110; and (B) the pin's elongate body 422 and each spring contact 106A-106D via a respective retention member 108A-108D. The pin 402, spring contacts 110, 106A-106D and retention members 108A-108D are formed of a conductive material, such as metal (e.g., copper or brass).

Figure 2:
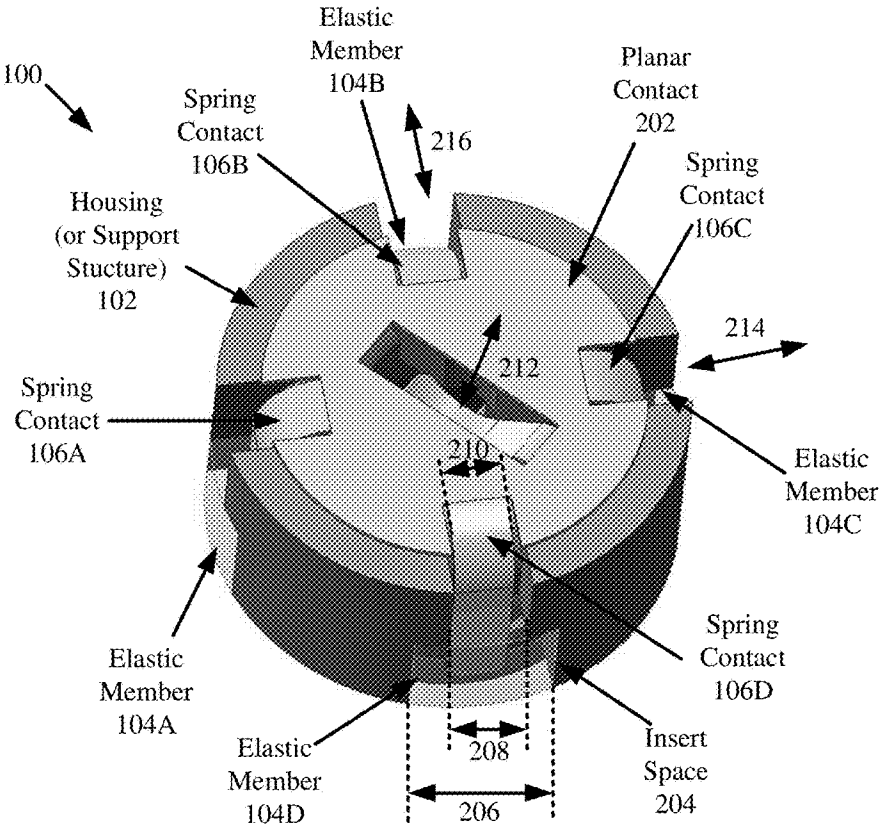
FIG. 2 is a bottom perspective view of the exemplary female receptacle shown in FIG. 1.
Figure 3:
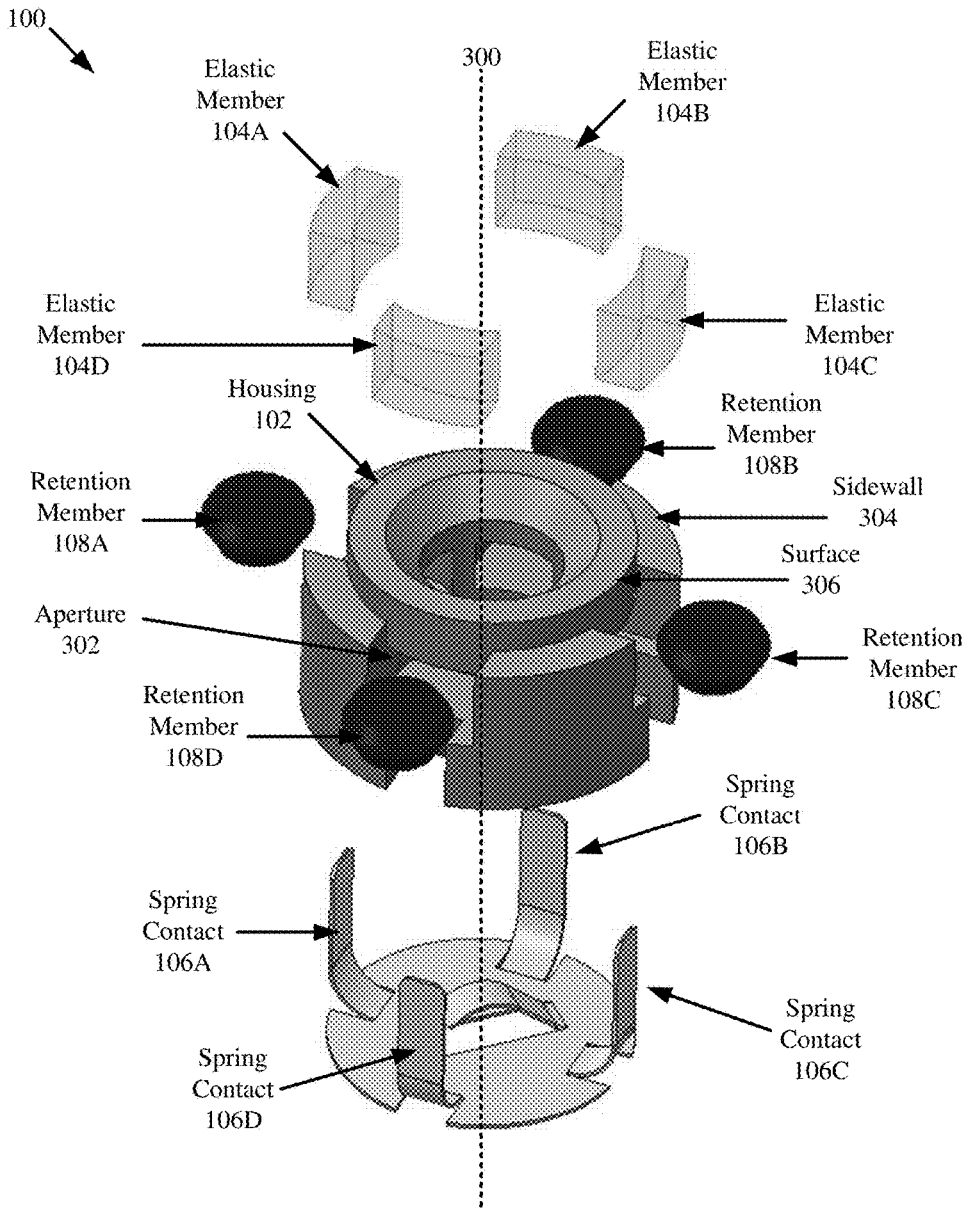
FIG. 3 is an exploded view of the exemplary female receptacle shown in FIG. 1.

The spring contacts 110, 106A-106D are electrically connected to each other via a planar contact 202. The spring contacts 110, 106A-106D can be integrally formed with the planar contact 202 so as to provide a single contact component as shown in FIG. 2. In this case, the single contact component can be formed from a circular planar plate.

The planar contact 202 is also formed of a conductive material, such as metal (e.g., copper or brass). The planar contact 202 provides a means to electrically connect the female receptacle 100 to external circuitry, such as that disposed on a PWB. In this case, solder and/or a wire can be used to establish this electrical connection.

Each spring contact 110, 106A-106D is designed to allow the pin 402 to float in the socket opening 112. Accordingly, each spring contact 110, 106A-106D protrudes out and away from the planar contact 202. For example, spring contact 110 extends horizontally and protrudes vertically out and away from a center of the planar contact 202. Each spring contact 106A-106D extends vertically and protrudes vertically out and away from a peripheral edge portion of the planar contact. In this regard, the housing 202 comprises a plurality of insert spaces 204 for receiving vertically extending spring contacts 106A-106D. Each insert space 204 has a generally T-Shape. The thinner portion of the insert space has a width 208 that is slightly larger than the width 210 of a spring contact 106A-106D. The wider portion of the insert space has a width 206 that is substantially similar (possibly slightly smaller) or the same as the width of an elastic member 104A-104D so that the elastic member 104A-104D is securely retained in the housing 202 with or without the assistance of an adhesive (e.g., via friction or by being molded in place so that a chemical reaction occurs at the contact surfaces of the housing and elastic members).

Each spring contact 110, 106A-106D is flexible so that when the female receptacle 100 is subjected to shock and/or vibration the electrical connection between itself and the pin 402 is maintained. For example, the spring contact 110 flexes in two (2) opposing vertical directions 212. Similarly, spring contacts 106A and 106C flex in two (2) opposing horizontal directions 214, and spring contacts 106B and 106D flex in two (2) opposing horizontal directions 216. The flexing of the spring contacts facilitates shock and vibration absorption by the female receptacle 100, as well as the elimination of the need for precision alignment for engagement between the male plug and the female receptacle 100. The elimination of the precision alignment requirement is also at least partially facilitated by the provision of an angled surface 114 in the socket opening 112. The angled surface 114 helps guide the pin 402 into proper placement within the socket opening 112 as shown in FIG. 4 (even when the center axis 418 of the pin 402 is not aligned with or is angled relative to a center axis 300 of the socket opening 412).

During shock and vibration, the pin 402 applies a pushing force on each retention member 108A-108D at respective times. As a result of this pushing force, the retention members slidingly move within the housing 102 in respective directions away from the center axis 300 of the socket opening 112. This movement causes the retention members 108A-108D to respectively apply pushing forces on the spring contacts 106A-106D. In turn, the spring contacts 108A-108D flex away from a surface 306 of the housing 102.

Throughout this process, each elastic member 104A-104D provides a retention force on the respective retention member 108A-108D (via spring contact 106A-106D) in a direction towards a center axis 300 of the female receptacle 100, i.e., the elastic members force the retention members toward the center of the female receptacle 100. The inward force applied by the elastic members ensures that the yield strength of the material (e.g., copper or brass) forming the spring contacts 106A-106D is not exceeded during times when (A) the pin 402 is being inserted into the female receptacle 100 and/or (B) the female receptacle 100 is subjected to shock and vibration. If this yield strength is exceeded, then the spring contacts 106A-106D may experience permanent deformation such that they do not spring back to their rest positions. In effect, the elastic members 104A-104D provide (A) structural support for the spring contact 106A-106D and (B) an inward force to ensure that the retention member 108A-108D are in contact with pin regardless of whether there is shock and vibration.

The elastic members 104A-104D are formed of an elastomer or other rubber. The elastic members 104A-104D have the same durometer. The present solution is not limited in this regard. In some scenarios, the elastic members 104A-104D have different durometers. Adjustments in durometers allow the retention forces of the elastic members 104A-104D to be tuned in accordance with a particular application. For example, each elastic member 104A-104D has a different durometer so that it reacts to different frequencies of shock and vibration as compared to that to which the other elastic members react. The tuning also facilitates one to define a breakaway force at which the male plug and female receptacle would disconnect from each other. This breakaway force feature of the present solution is valuable in scenarios where equipment damage is undesirable as a result of certain events (e.g., when a pulling force of greater than about fifty (50) pounds is applied to the coupled male plug/female receptacle).

In some scenarios, the spring contacts 106A-106D have the same spring rates. In other scenarios, the spring contacts 106A-106D have different spring rates. The adjustment of spring rates allows the spring contacts to have the same or different natural frequencies selected in accordance with a particular application.

As shown in FIGS. 1-4, the retention members 108A, 108B, 108C, 108D each have a generally disc or circular shape. The present solution is not limited in this regard. The retention members 108A, 108B, 108C, 108D can have any shape selected in accordance with a particular application. For example, the retention members 108A, 108B, 108C, 108D can alternatively have rectangular, square, spherical or elliptical shapes.

Referring now to FIG. 4, the insertion of the pin 402 into the socket opening 112 is described. First, it should be appreciated that the retention members 108A-108D are respectively resiliently biased to first positions (shown in FIG. 1) by the contact springs 106A-106D. In the first positions, at least a portion each retention member 108A-108D protrudes a certain distance into the socket opening 112.

As the pin 402 is inserted into the socket opening 112, a chamfered edge 404 of the pin 402 slides against the chamfered edges 406 of the retention members 108A-108D. This sliding causes the pin 402 to urge the retention members 108A-108D in respective outward directions 450 away from the center axis 300 of the female receptacle 100. In turn, the retention members 108A-108D apply pushing forces on the spring contacts 106A-106D, whereby the spring contacts 106A-106D flex in a direction out and away from the pin 402. Once the pin 402 is inserted a certain distance into the socket opening 112, the retention members 108A-108D automatically move in an opposing direction 452 towards the center axis 300 of the female receptacle 100.

Notably, the pin 402 has an end portion with a generally hour glass shape, i.e., the diameter of proximal end portion 408 is smaller than the diameter of distal end portion 410. The decrease in the pin's diameter facilitates the automatic movement of the retention members 108A-108D towards the center axis 300 of the female receptacle 100. This movement is also facilitated by the inward forces respectively applied by (A) the spring contacts 106A-106D to the retention members 108A-108D and/or (B) the elastic members 104A-104D to the spring contacts 106A-106D.

As shown in FIG. 4, the retention members 108A-108D also have chamfered edges 412 opposed from chamfered edges 406. Chamfered edges 412 facilitate the removal of pin 402 from socket opening 112. In order for the male plug to be decoupled from the female receptacle 100, the pulling force needs to be sufficient to overcome the spring force of the spring contacts 106A-106D. Once the spring force is overcome, the chamfered edge 412 of the retention member slides against the chamfered edge 416 of the pin 402. This sliding causes the pin 402 to urge the retention members 108A-108D in outward directions 450. When the pin 402 is removed from the socket opening 112, the retention members 108A-108D return to their first (or rest) positions shown in FIG. 1 as result of the spring force applied thereto by the spring contacts 106A-106D.

Notably, the male plug can be decoupled from the female receptacle even when in a position that is angled relative to the female receptacle. This is at least partially possible since the pin 402 floats in the socket opening 112 and/or since an angled surface 114 is provided at the entrance of the socket opening. The angled surface 114 acts as a guide for directing the pin 402 into proper placement within the socket opening 112.

The present solution is not limited to the chamfered pin and retention member configuration shown in FIG. 4. In other scenarios, the pin 402 and retention members 108A-108D are designed so that the pin 402 is unable to be removed from socket opening 112. For example, both components 402, 108A-108D can be designed with mating right angled features. In those or other scenarios, the male plug and female receptacle can include housings with mating mechanical coupling means for securely coupling themselves to each other. Such a mechanical coupling means can include, but is not limited to, snap couplers and/or locking tabs.

It should be noted that the housing 102 has a plurality of apertures 302 formed in a sidewall 304 thereof. Each aperture 302 is aligned with a portion of a respective insert space 204. In some scenarios, the apertures are shaped so as to ensure that the retention members 108A-108D are retained in the socket opening 112 and/or protrude only a certain distance into the socket opening 112 when the pin 402 is not inserted therein. For example, each aperture 302 may have an inner dimension (e.g., width and/or height) that is smaller than an outer dimension (e.g., width and/or height).

The present solution is not limited to the housing and/or elastic member architecture shown in FIGS. 1-4. For example, a single elastic member can be provided instead of four (4) separate elastic members 104A-104D. Schematic illustrations are provided in FIGS. 5-9 showing an exemplary architecture of an electrical connector in accordance with a single elastic member implementation. The electrical connector comprises a female receptacle 500 and a male plug (not shown in FIGS. 5-9) with a pin 800.

Figure 1:
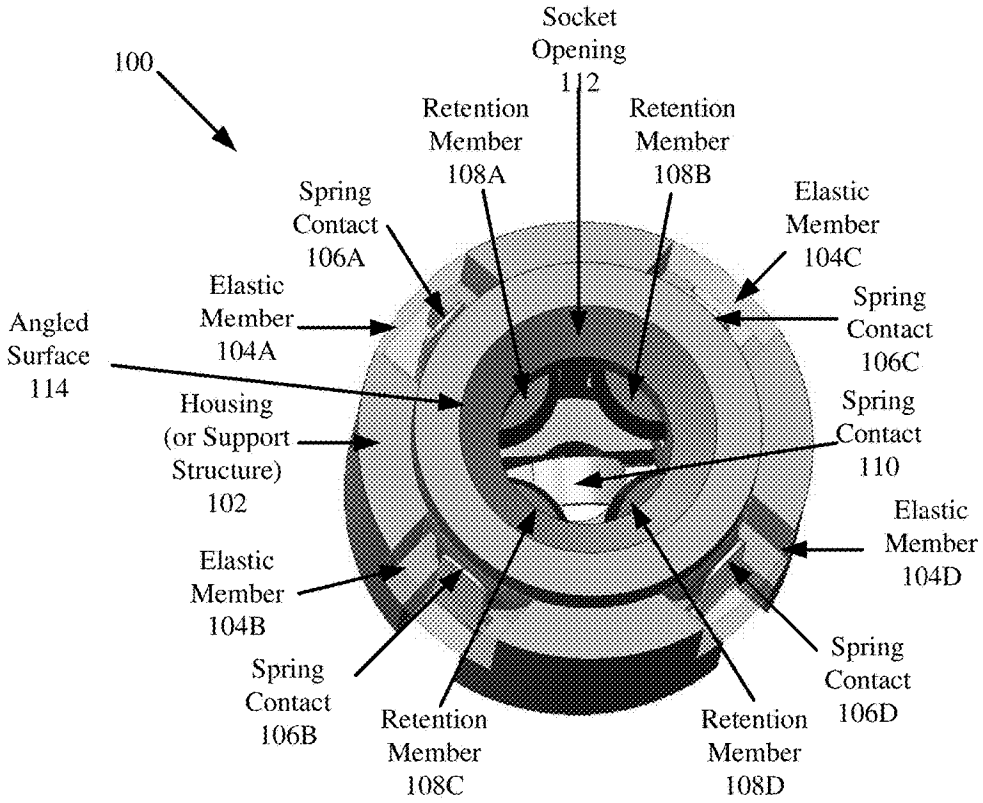
FIG. 1 is a top perspective view of an exemplary female receptacle.

The female receptacle 500 is substantially similar to the female receptacle 100 of FIG. 1 with the exception of the elastic member 502. As such, the discussion provided above in relation to the female receptacle 100 of FIG. 1 is sufficient for understanding the female receptacle 500. However, a discussion of the elastic member 502 is now provided.

The elastic member 502 is designed to have a plurality of purposes: (A) provide structural support for the spring contacts 506; (B) provide an inward force to ensure that the retention members 508 are in contact with the pin 800 regardless of whether the female receptacle 500 is being subjected to shock and vibration; and/or (C) provide an environmental seal for preventing or reducing the ingress of contaminants (e.g., dirt, dust, sand, water, etc.) into the female receptacle 500.

Figure 9:
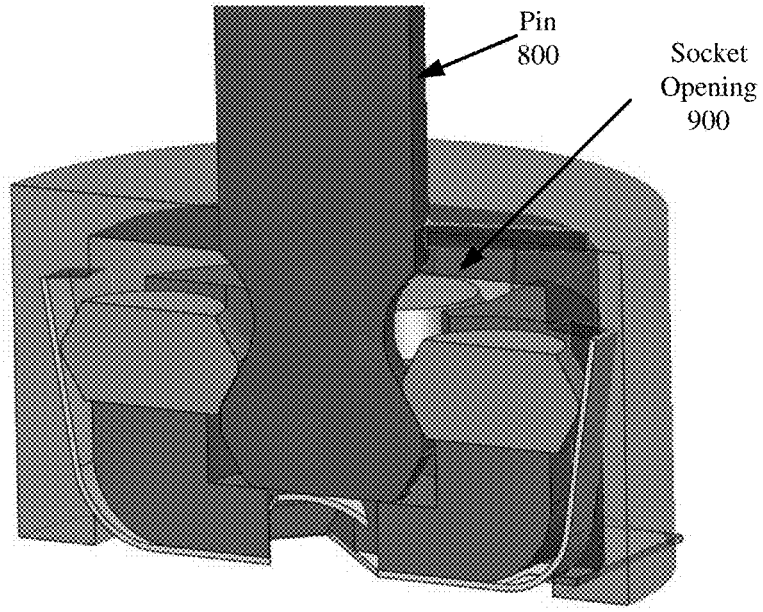
FIG. 9 is a cross-sectional view of the exemplary female receptacle shown in FIG. 5 with a pin of a male plug inserted therein.

Notably, the elastic member 502 has a generally U-cross sectional shape with slits 600 formed in a surface 602 thereof. The slits 600 allow the pin 800 to pass therethrough when a downward force is applied thereto, while at least reducing the amount of contaminants entering the female receptacle 500. A schematic illustration is provided in FIG. 8 which shows the pin 800 inserted into the female receptacle 500. A cross-sectional view of the pin 800 inserted into the female receptacle is provided in FIG. 9. When the pin 800 is fully inserted into the female receptacle 500, the environmental seal is also provided by the elastic member 502 as shown in FIG. 9 (i.e., the elastic member 502 circumscribed the pin 800 so as to provide the environmental seal).

In this scenario, the elastic member 502 has a single durometer. The ability to provide a plurality of elastic members with different durometers may not be possible here. However, the spring contacts 506 can have the same or different spring rates. Adjustments of the spring rates allows the spring contacts to have the same or different natural frequencies selected in accordance with a particular application. If effect, the spring contacts 506 can be selectively designed so that they react to the same or different frequencies of shock and vibration, i.e., the natural frequencies of the spring contacts can be tuned. The tuning facilitates one to define a breakaway force at which the male plug and female receptacle would disconnect from each other. This breakaway force feature of the present solution is valuable in scenarios where equipment damage is undesirable as a result of certain events (e.g., when a pulling force of greater than about fifty (50) pounds is applied to male plug/female receptacle).

Figure 16:
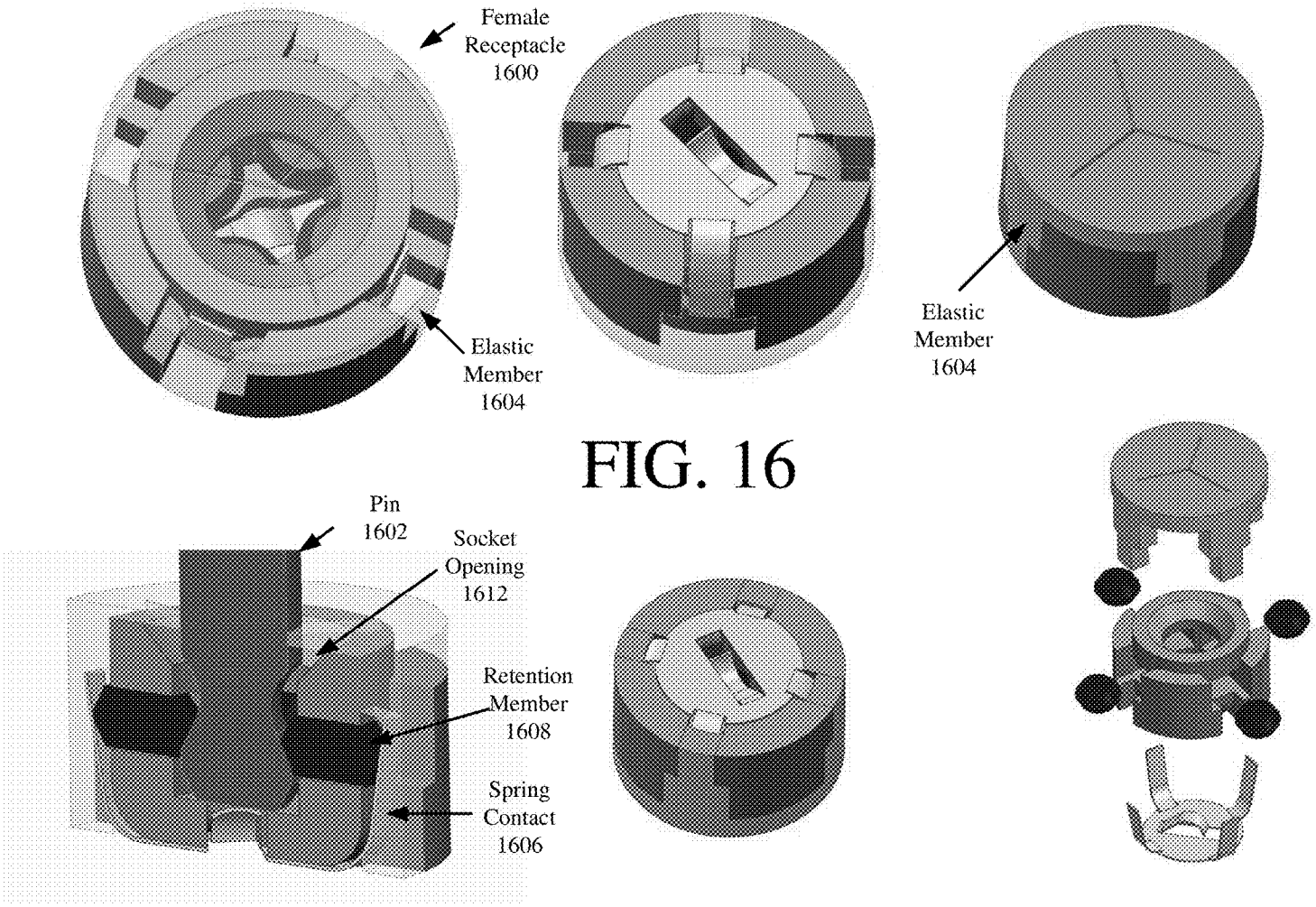
FIG. 16 provides illustrations of another exemplary architecture for a female receptacle.

The present solution is not limited to the particular architecture of the elastic member shown in FIGS. 5-9. Another exemplary architecture for the elastic member is shown in FIG. 16. In both cases, the elastic member is designed to provide an environmental seal for preventing or reducing the ingress of contaminants into the female receptacle during use thereof.

Notably, various components shown in FIG. 16 are the same as or substantially similar to that shown in FIGS. 1-4. For example, these components include the housing, spring contacts, planar contact, and retention members. As such, the discussion provided above in relation to FIGS. 1-4 is sufficient for understanding these components of the female receptacle 1600 shown in FIG. 16.

Referring now to FIGS. 10-15, there are provided illustrations that are useful for understanding an exemplary architecture for an electrical connector 1000 with a plurality of pin/socket pairs. Each pin/socket pair is substantially similar to the pin/socket pair described above in relation to FIGS. 1-5.

As shown in FIGS. 10-15, the electrical connector 1000 comprises a male plug 1002 and a female receptacle 1004. The male plug 1002 comprises a housing 1004 and a plurality of pins 1006. The housing is designed to provide a handle 1008 to facilitate the insertion of the pins 1006 into mating sockets 1300 of the female receptacle 1004. Seven (7) pins 1006 are shown in FIGS. 10-11. The present solution is not limited in this regard. Any number of pins can be employed in accordance with a particular application. The pins 1006 are formed of a conductive material (e.g., copper or brass). The pins 1006 are arranged relative to each other so that each pin is aligned with a respective socket 1300 of the female receptacle 1004 when the electrical components 1002, 1004 are being coupled to each other.

The female receptacle 1004 comprises a housing 1010 with a plurality of socket openings 1012 formed therein. Each socket opening 1012 is sized and shaped for receiving a respective pin 1006.

An insert space 1102 is provided which allows a contact retainer 1014 to be inserted and retained in the housing 1010. The retention of the contact retainer 1014 is at least partially achieved via engagement of protrusions 1104 formed on a sidewall 1106 of the insert space 1102 and protrusions 1108 formed on a sidewall 1110 of the contact retainer 1014. An adhesive or other coupling means may also be employed for securely coupling the contact retainer 1014 to the housing 1010.

Figure 12:
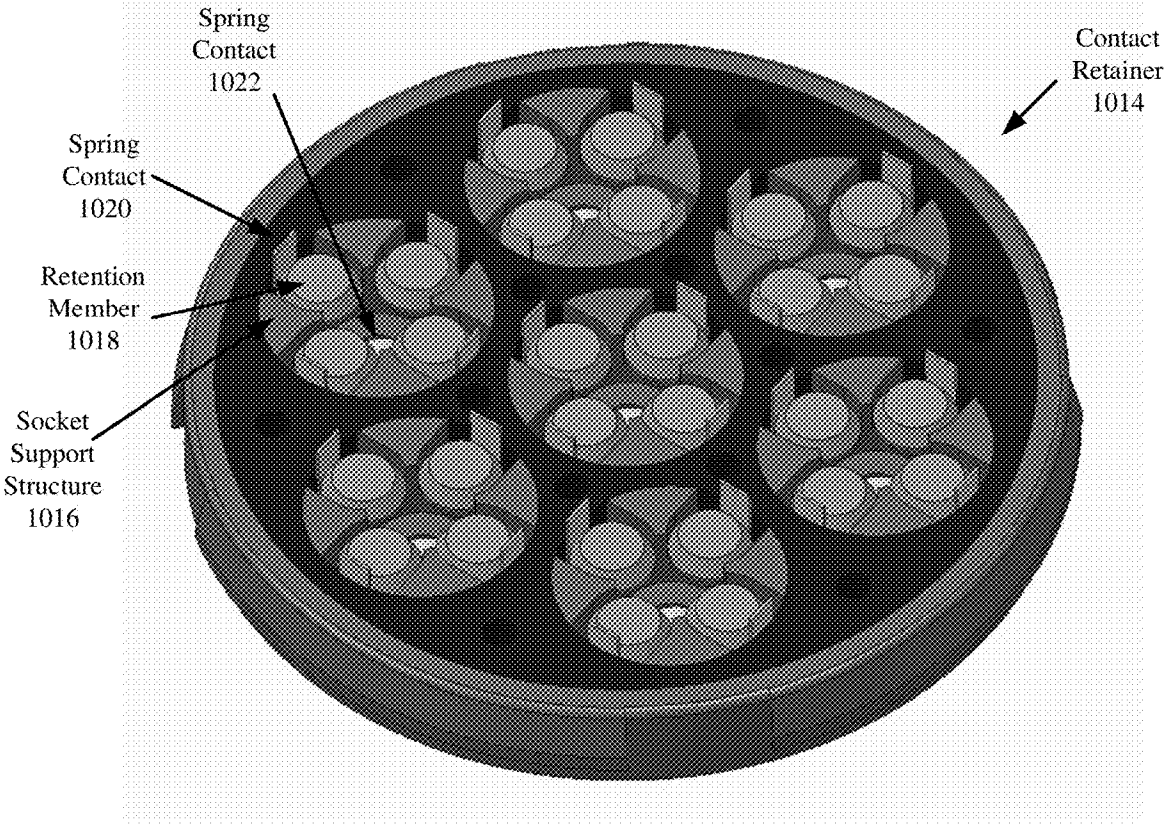
FIG. 12 is a top perspective view of internal components of the female receptacle shown in FIGS. 10-11.
Figure 13:
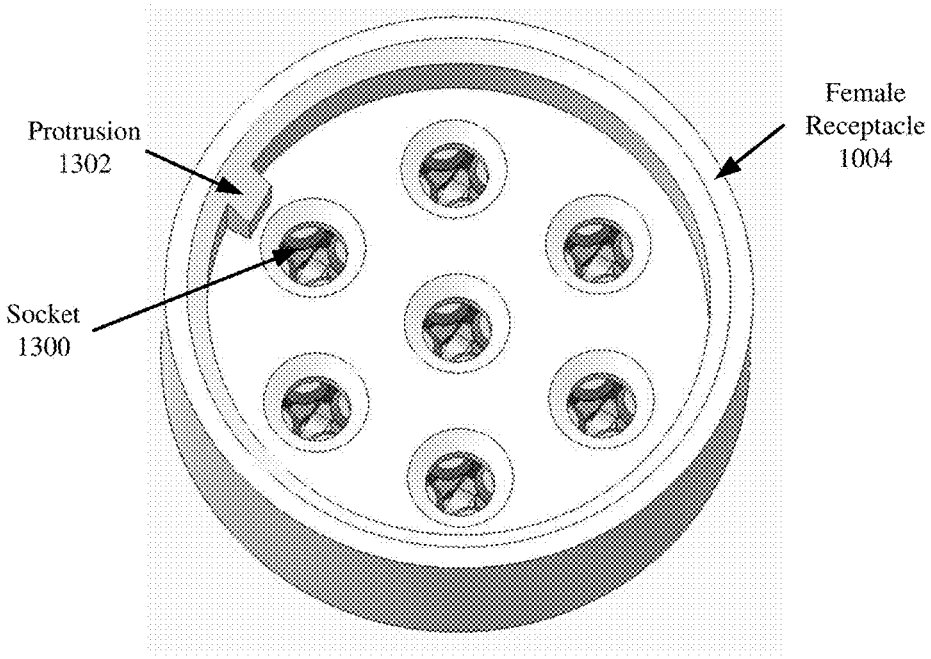
FIG. 13 is a top perspective view of the assembled electrical connection of FIGS. 10-12.
Figure 14:
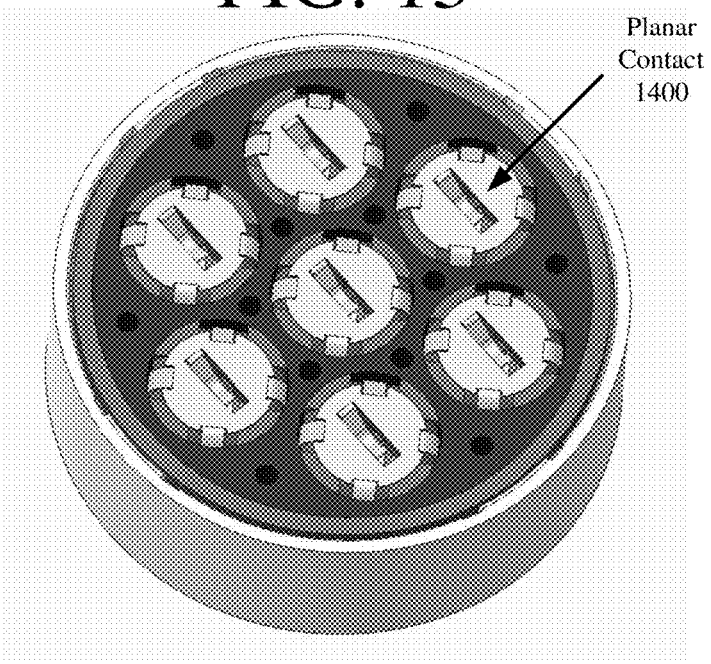
FIG. 14 is a bottom perspective view of the assembled electrical connection of FIGS. 10-13.
Figure 15:
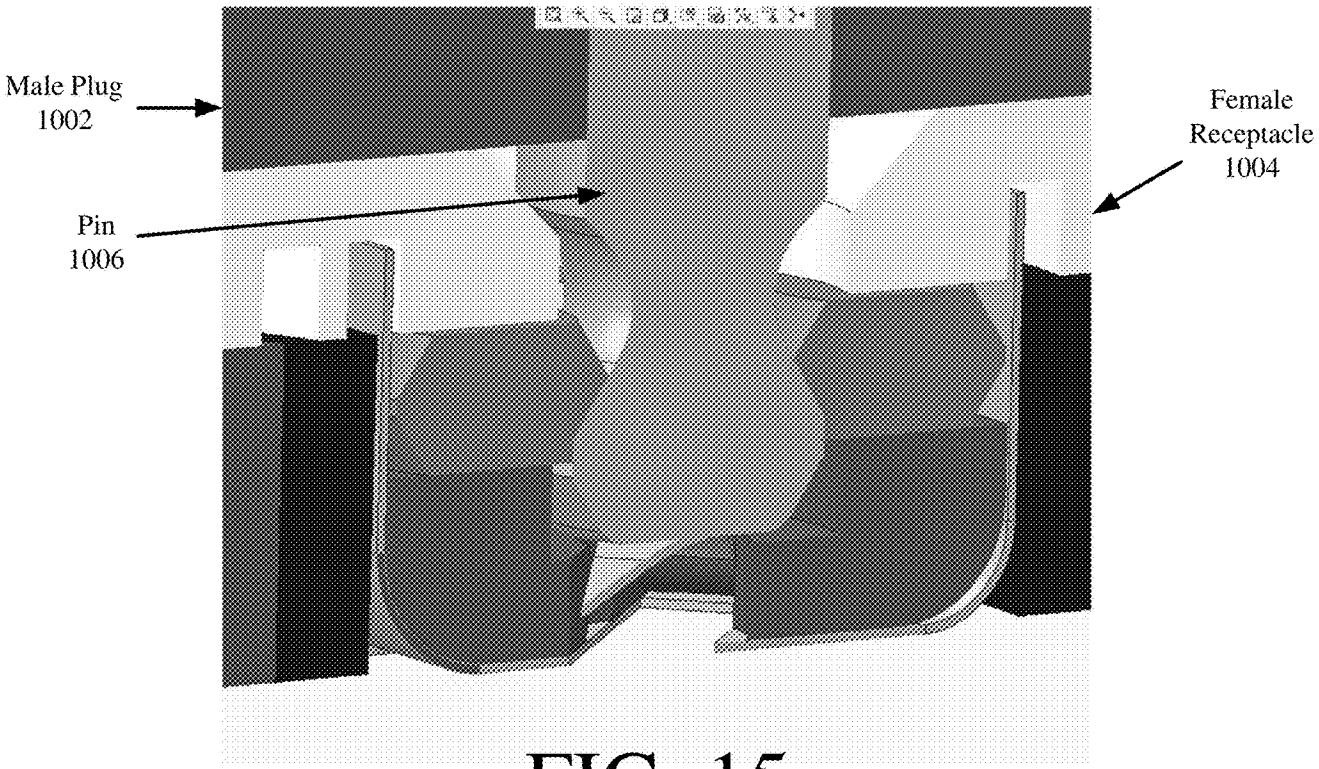
FIG. 15 is a partial cross-sectional view of the male plug shown in FIGS. 10-11 coupled to the female receptacle shown in FIGS. 10-11.

The contact retainer 1014 comprises a dielectric support structure 1112 and an elastic member 1114. The elastic member 1114 is disposed in and structurally supported by the dielectric support structure 1112. The elastic member 1114 has a plurality of apertures 1014 formed therethrough. Each aperture 1014 is sized and shape to receive a respective socket support structure 1016. Each socket support structure 1016 is designed to receive respective retention members 1018 and spring contacts 1020, 1022, as well as provide structural support to these components and retain these components in a particular relative configuration as shown in FIG. 12. In some scenarios, the socket support structures 1016 are formed of a rigid or semi-rigid material, such as plastic. Each socket support structure 1016 is also designed so that surface of the planar contacts 1400 are exposed when the female receptacle 1004 is assembled as shown in FIG. 14 so that the planar contacts 1400 can be electrically connected to an external circuit (e.g., a circuit disposed on a PWB).

Notably, the overall structure of each socket (i.e., defined by socket support structure 1016, retention members 1018 and spring contacts 1020, 1022) is similar to that shown in FIGS. 1-4, 5-9 and/or FIG. 16 and described above. The discussion provided above is sufficient for understanding the socket components of the female receptacle 1004.

In some scenarios, the male plug and the female receptacle are designed to allow for decoupling thereof. In other scenarios, the male plug and the female receptacle are designed so that they cannot be decoupled from each other. In this case, mating mechanical coupling means may be provided for securely coupling the male plug and female receptacle together. Such a mechanical coupling means can include, but is not limited to, snap couplers and/or locking tabs (e.g., protrusion 1302 of FIG. 13).

Figure 5:
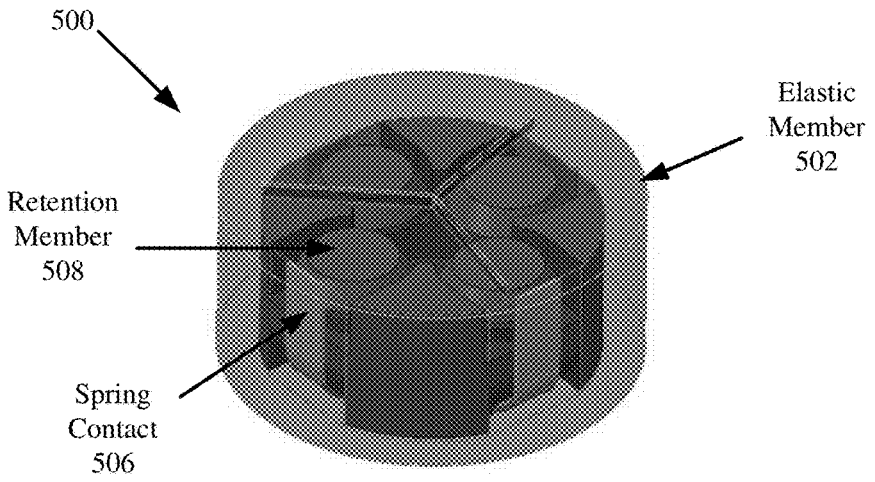
FIG. 5 is a top perspective view of another exemplary female receptacle.
Figure 6:
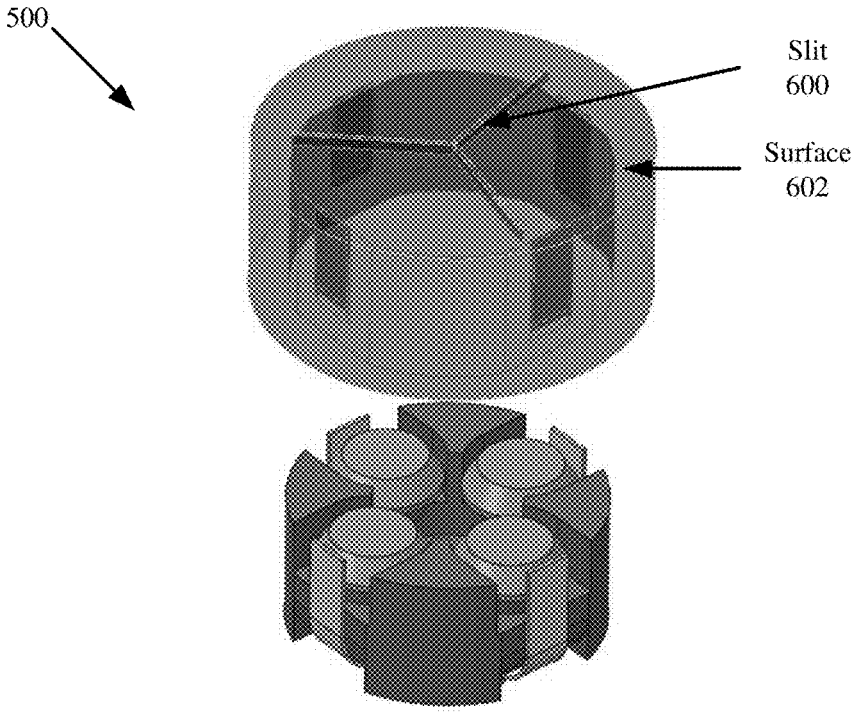
FIG. 6 is a top perspective view of the exemplary female receptacle shown in FIG. 5 with the elastic member removed therefrom.
Figure 7:
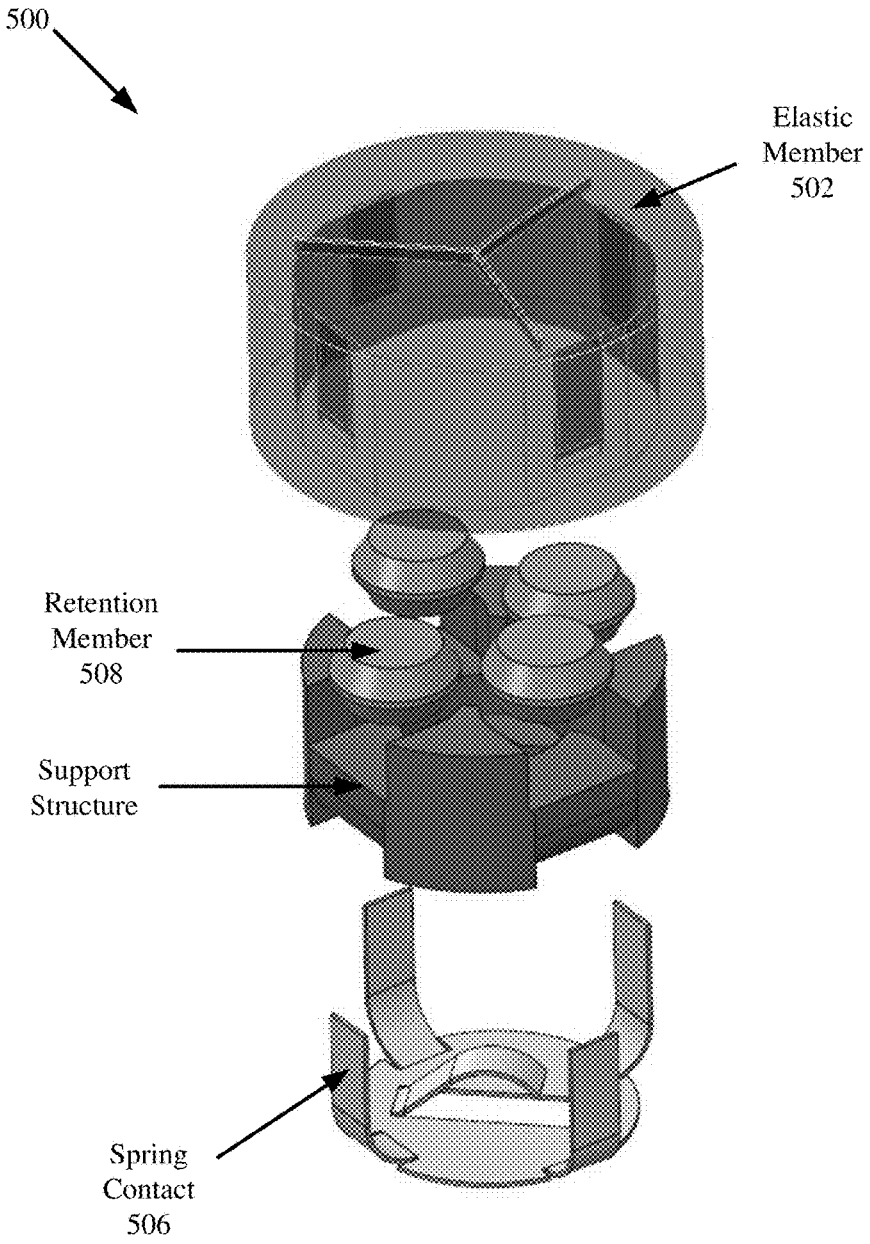
FIG. 7 is an exploded view of the exemplary female receptacle shown in FIG. 5.
Figure 8:
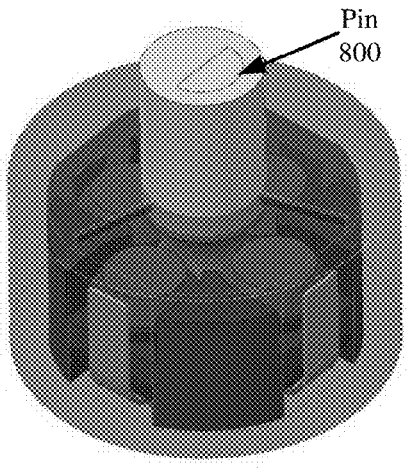
FIG. 8 is an illustration showing a pin of a male plug inserted into the female receptacle shown in FIG. 5.
Figure 17:
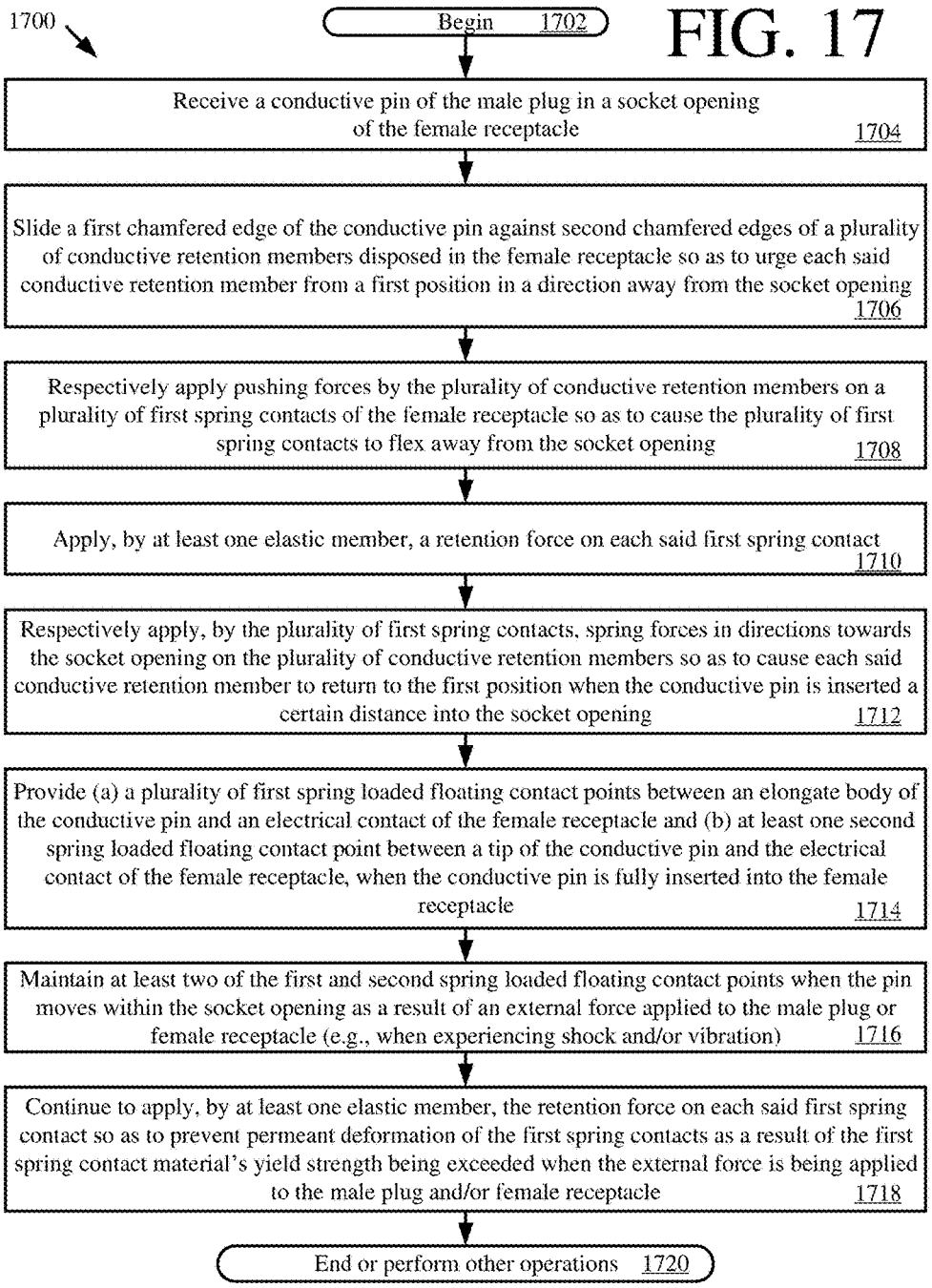
FIG. 17 is a flow diagram of an exemplary method for providing an electrical interface between a male plug and a female receptacle.

Referring now to FIG. 17, there is provided a flow diagram of an exemplary method 1700 for providing an electrical interface between a male plug (e.g., male plug 1002 of FIG. 10 and a female receptacle (e.g., female receptacle 100 of FIG. 1, 500 of FIG. 5, 1004 of FIG. 10, or 1600 of FIG. 16). Method 1700 begins with 1702 and continues with 1704 where a conductive pin (e.g., pin 402 of FIG. 4, 800 of FIG. 8, 1006 of FIG. 10, or 1602 of FIG. 16) of the male plug is received in a socket opening (e.g., socket opening 112 of FIG. 1, 900 of FIG. 9, 1012 of FIG. 10, or 1612 of FIG. 16) of the female receptacle. As the conductive pin is inserted into the socket opening, the events described in 1706-1712 occur. These events comprise: sliding a first chamfered edge (e.g., chamfered edge 404 of FIG. 4) of the conductive pin against second chamfered edges (e.g., chamfered edge 406 of FIG. 4) of a plurality of conductive retention members (e.g., retention members 108A-108D of FIG. 1, 508 of FIG. 5, 1018 of FIG. 10, or 1608 of FIG. 16) disposed in the female receptacle so as to urge each said conductive retention member from a first position (e.g., shown in FIG. 1) in a direction away from the socket opening; respectively applying pushing forces by the plurality of conductive retention members on a plurality of first spring contacts (e.g., spring contacts 106A-106B of FIG. 1, 506 of FIG. 5, 1020 of FIG. 10, or 1606 of FIG. 16) so as to cause the plurality of first spring contacts to flex away from the socket opening; applying, by at least one elastic member (e.g., elastic member 104A-104D of FIG. 1, 502 of FIG. 5, 1114 of FIG. 11, or 1604 of FIG. 16), a retention force on each said first spring contact; and respectively applying, by the plurality of first spring contacts, spring forces in directions towards the socket opening on the plurality of conductive retention members so as to cause each said conductive retention member to return to the first position when the conductive pin is inserted a certain distance into the socket opening.

Once the pin is fully inserted into the socket opening, a plurality of floating contact points is provided as shown by 1714. These floating contact points include: a plurality of first spring loaded floating contact points (e.g., contact points 460 of FIG. 4) provided between an elongate body (e.g., elongate body 422 of FIG. 4) of the conductive pin and an electrical contact (e.g., electrical contact partially defined by spring contacts 106A-106B of FIG. 1) of the female receptacle; and at least one second spring loaded floating contact point (e.g., contact point 462 of FIG. 4) provided between a tip (e.g., tip 420 of FIG. 4) of the conductive pin and the electrical contact (e.g., electrical contact partially defined by spring contact 110 of FIG. 1) of the female receptacle. Notably, at least two of the first and second spring loaded floating contact points are maintained when the pin moves within the socket opening as a result of an external force applied to the male plug or female receptacle (e.g., when experiencing shock and/or vibration), as shown by 1716. Also, the elastic member continues to apply the retention force to each first spring contact so as to prevent permanent deformation to the same as a result of the first spring contact material's yield strength being exceeded when the external force is being applied to the male plug and/or female receptacle, as shown by 1718. The elastic member may also provide an environmental seal at least reducing an ingress of contaminants into the socket opening. Thereafter, method 1700 ends in 1720 or other operations are performed.

In some scenarios, the plurality of first spring loaded floating contact points is provided by the first conductive spring contacts respectively applying spring forces on the conductive retention members slidingly disposed in a support structure (e.g., housing 102 of FIG. 1) of the female receptacle and in direct contact with the elongate body of the conductive pin. The first conductive spring contacts are spaced apart along a periphery of a support structure of the female receptacle (e.g., as shown in FIG. 1). The second spring loaded floating contact point is provided by the second spring contact that is in direct contact with the conductive pin's tip. The first and second elongate spring contacts are electrically connected to each other via a planar contact (e.g., planar contact 202 of FIG. 2) provided for connecting the female receptacle's electrical contact to an external circuit.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

We claim:

1. A method for providing an electrical interface between a male plug and a female receptacle, comprising:

receiving a conductive pin of the male plug in a socket opening of the female receptacle;

providing (a) a plurality of first spring loaded floating contact points between an elongate body of the conductive pin and the female receptacle and (b) at least one second spring loaded floating contact point between a tip of the conductive pin and the female receptacle, when the conductive pin is fully inserted into the female receptacle; and maintaining at least two of the first and second spring loaded floating contact points when the pin moves within the socket opening as a result of an external force applied to the male plug or female receptacle;

wherein the female receptacle comprises a center axis along which the conductive pin extends when fully inserted in the female receptacle, and at least a portion of the at least one second spring loaded floating contact point passes through the central axis of the female receptacle.

2. A method for providing an electrical interface between a male plug and a female receptacle, comprising:

receiving a conductive pin of the male plug in a socket opening of the female receptacle;

providing (a) a plurality of first spring loaded floating contact points between an elongate body of the conductive pin and the female receptacle and (b) at least one second spring loaded floating contact point between a tip of the conductive pin and the female receptacle, when the conductive pin is fully inserted into the female receptacle; and maintaining at least two of the first and second spring loaded floating contact points when the pin moves within the socket opening as a result of an external force applied to the male plug or female receptacle;

wherein the plurality of first spring loaded floating contact points is provided by a plurality of first conductive spring contacts respectively applying spring forces on a plurality of conductive retention members slidingly disposed in a support structure of the female receptacle and in direct contact with the elongate body of the conductive pin.

3. The method according to claim 2, wherein the first conductive spring contacts are spaced apart along a periphery of a support structure of the female receptacle.

4. The method according to claim 2, wherein the second spring loaded floating contact point is provided by a second spring contact that is in direct contact with the conductive pin's tip.

5. The method according to claim 2, wherein an elastic member applies a retention force on each said first conductive spring contact in a direction towards a center axis of the female receptacle.

6. The method according to claim 5, wherein the elastic member provides an environmental seal at least reducing an ingress of contaminants into the socket opening.

7. A method for providing an electrical interface between a male plug and a female receptacle, comprising:

receiving a conductive pin of the male plug in a socket opening of the female receptacle;

providing (a) a plurality of first spring loaded floating contact points between an elongate body of the conductive pin and the female receptacle and (b) at least one second spring loaded floating contact point between a tip of the conductive pin and the female receptacle, when the conductive pin is fully inserted into the female receptacle; and maintaining at least two of the first and second spring loaded floating contact points when the pin moves within the socket opening as a result of an external force applied to the male plug or female receptacle;

wherein the female receptacle comprises an electrical contact formed of a plurality of first elongate spring contacts extending in a first direction parallel to the center axis of the socket opening and at least partially facilitating the plurality of first spring loaded floating contact points, and a second elongate spring contact extending in a second direction different than the first direction and at least partially facilitating the at least one second spring loaded floating contact point.

8. The method according to claim 7, wherein the first and second elongate spring contacts are electrically connected to each other via a planar contact provided for connecting the female receptacle's electrical contact to an external circuit.

9. A method for providing an electrical interface between a male plug and a female receptacle, comprising:

receiving a conductive pin of the male plug in a socket opening of the female receptacle;

providing (a) a plurality of first spring loaded floating contact points between an elongate body of the conductive pin and the female receptacle and (b) at least one second spring loaded floating contact point between a tip of the conductive pin and the female receptacle, when the conductive pin is fully inserted into the female receptacle;

maintaining at least two of the first and second spring loaded floating contact points when the pin moves within the socket opening as a result of an external force applied to the male plug or female receptacle;

sliding a first chamfered edge of the conductive pin against second chamfered edges of a plurality of conductive retention members disposed in the female receptacle so as to urge each said conductive retention member from a first position in a direction away from the socket opening;

respectively applying pushing forces by the plurality of conductive retention members on a plurality of first spring contacts so as to cause the plurality of first spring contacts to flex away from the socket opening; and respectively applying, by the plurality of first spring contacts, spring forces in directions towards the socket opening on the plurality of conductive retention members so as to cause each said conductive retention member to return to the first position when the conductive pin is inserted a certain distance into the socket opening.

10. The method according to claim 9, further comprising applying, by at least one elastic member, a retention force on each said first spring contact so as to prevent permanent deformation to each said first spring contact.

11. An electrical connector, comprising:

a male plug having at least one conductive pin; and a female receptacle comprising an electrical contact and a socket opening sized and shaped to receive the conductive pin of the male plug;

wherein (a) a plurality of first spring loaded floating contact points are provided between an elongate body of the conductive pin and the female receptacle and (b) at least one second spring loaded floating contact point is provided between a tip of the conductive pin and the female receptacle, when the conductive pin is fully inserted into the female receptacle; and wherein at least two of the first and second spring loaded floating contact points are maintained when the pin moves within the socket opening as a result of an external force applied to the male plug or female receptacle; and wherein the female receptacle comprises a center axis along which the conductive pin extends when fully inserted in the female receptacle, and at least a portion of the at least one second spring loaded floating contact point passes through the central axis of the female receptacle.

12. An electrical connector, comprising:

a male plug having at least one conductive pin; and a female receptacle comprising an electrical contact and a socket opening sized and shaped to receive the conductive pin of the male plug;

wherein (a) a plurality of first spring loaded floating contact points are provided between an elongate body of the conductive pin and the female receptacle and (b) at least one second spring loaded floating contact point is provided between a tip of the conductive pin and the female receptacle, when the conductive pin is fully inserted into the female receptacle;

wherein at least two of the first and second spring loaded floating contact points are maintained when the pin moves within the socket opening as a result of an external force applied to the male plug or female receptacle; and wherein the plurality of first spring loaded floating contact points is provided by a plurality of first conductive spring contacts respectively applying spring forces on a plurality of conductive retention members slidingly disposed in a support structure of the female receptacle and in direct contact with the elongate body of the conductive pin.

13. The electrical connector according to claim 12, wherein the first conductive spring contacts are spaced apart along a periphery of a support structure of the female receptacle.

14. The electrical connector according to claim 12, wherein the second spring loaded floating contact point is provided by a second spring contact that is in direct contact with the conductive pin's tip.

15. The electrical connector according to claim 12, wherein the female receptacle further comprises an elastic member applying a retention force on each said first conductive spring contact in a direction towards a center axis of the female receptacle.

16. The electrical connector according to claim 15, wherein the elastic member provides an environmental seal at least reducing an ingress of contaminants into the socket opening.

17. The electrical connector according to claim 12, wherein the female receptacle further comprises conductive retention members that (a) are each urged from a first position in a direction away from the socket opening when a first chamfered edge of the conductive pin slides against second chamfered edges of the conductive retention members, (b) respectively apply pushing forces on a plurality of first spring contacts when urged from the first position so as to cause the plurality of first spring contacts to flex away from the socket opening, and (c) return to the first position, when the conductive pin is inserted a certain distance into the socket opening, as a result of spring forces respectively applied by the plurality of first spring contacts in directions towards the socket opening on the conductive retention members.

18. The electrical connector according to claim 17, wherein the female receptacle further comprises at least one elastic member that applies a retention force on each said first spring contact so as to prevent permanent deformation to each said first spring contact.

19. An electrical connector, comprising:

a male plug having at least one conductive pin; and a female receptacle comprising an electrical contact and a socket opening sized and shaped to receive the conductive pin of the male plug;

wherein (a) a plurality of first spring loaded floating contact points are provided between an elongate body of the conductive pin and the female receptacle and (b) at least one second spring loaded floating contact point is provided between a tip of the conductive pin and the female receptacle, when the conductive pin is fully inserted into the female receptacle;

wherein at least two of the first and second spring loaded floating contact points are maintained when the pin moves within the socket opening as a result of an external force applied to the male plug or female receptacle; and wherein the female receptacle comprises an electrical contact formed of a plurality of first elongate spring contacts extending in a first direction parallel to the center axis of the socket opening and at least partially facilitating the plurality of first spring loaded floating contact points, and a second elongate spring contact extending in a second direction different than the first direction and at least partially facilitating the at least one second spring loaded floating contact point.

20. The electrical connector according to claim 19, wherein the first and second elongate spring contacts are electrically connected to each other via a planar contact provided for connecting the female receptacle's electrical contact to an external circuit.

* * * * *